United States Patent [19]

Mounsey et al.

[11] 4,394,357

[45] Jul. 19, 1983

[54] SEPARATION OF COBALT AND NICKEL BY OXIDATIVE PRECIPITATION WITH PEROXYMONOSULFURIC ACID

[75] Inventors: Diana M. Mounsey, Runcorn; David B. Mobbs, Handforth, both of England

[73] Assignee: Interox Chemicals Ltd., London, England

[21] Appl. No.: 321,575

[22] Filed: Nov. 16, 1981

[30] Foreign Application Priority Data

Dec. 5, 1980 [GB] United Kingdom ..... 8039084

[51] Int. Cl.[3] ..... C01G 51/00

[52] U.S. Cl. ..... 423/140; 423/144; 423/147; 423/513

[58] Field of Search ..... 423/140, 144, 147

[56] References Cited

U.S. PATENT DOCUMENTS

| | | | |
|---|---|---|---|
| 2,377,832 | 6/1945 | Wallis | 423/140 |
| 2,488,561 | 11/1949 | School | 423/140 |
| 2,726,144 | 12/1955 | Wallis | 423/140 |
| 2,842,427 | 7/1958 | Reynaud | 423/140 |
| 2,971,836 | 2/1961 | Hall | 423/140 |
| 2,977,221 | 3/1961 | Howling | 423/140 |
| 4,198,337 | 4/1980 | Burkin | 423/140 |
| 4,301,125 | 11/1981 | Burkin | 423/147 |

FOREIGN PATENT DOCUMENTS

| | | | |
|---|---|---|---|
| 1320334 | 6/1973 | United Kingdom | 423/147 |

OTHER PUBLICATIONS

*Chemical Abstracts,* vol. 93, (1980), No. P208125x.

*Primary Examiner*—Brian E. Hearn

*Attorney, Agent, or Firm*—Larson and Taylor

[57] ABSTRACT

The invention relates to the preferential precipitation of cobalt from aqueous acidic sulphate solutions of nickel and cobalt.

The separation is carried out by introducing at least a stoichiometric amount of Caro's Acid containing no more than a small amount of hydrogen peroxide into the nickel/cobalt solution progressively over a period of at least an hour, while maintaining the solution of a pH from 3.1 or 3.5 up to 4.7 by addition of an alkali metal hydroxide carbonate or bicarbonate, or at 4.3 to 4.7 with the corresponding ammonium compound, and, thereafter separating the precipitate from the aqueous cobalt depleted solution.

In preferred features, the Caro's Acid solution used contains hydrogen peroxide in a mole ratio to peroxomonosulphuric acid of not more than 1:10; the Caro's Acid solution is introduced continuously or in increments of less than 1% of the total over a period of at least an hour; the Caro's Acid is produced by reaction between 93–98% sulphuric acid and 65–72% aqueous hydrogen peroxide in a mole ratio of 2.7:1 to 3.5:1; the Caro's Acid solution is diluted before use; and particular amounts of Caro's Acid are used depending upon the nature of the nickel/cobalt solution, the mode of treatment, and the nature of the neutralizing agent. Further separation can be effected by subsequent water and particularly not acid washing of the precipitate.

19 Claims, No Drawings

SEPARATION OF COBALT AND NICKEL BY OXIDATIVE PRECIPITATION WITH PEROXYMONOSULFURIC ACID

The present invention relates to a process for the separation of cobalt and nickel from aqueous acidic solutions containing a mixture thereof, more particularly involving oxidation and precipitation of the cobalt.

Acid solutions of nickel and cobalt for further processing tend to fall into two categories. In the first category, where the nickel and cobalt solution has been obtained in the processing of a nickel matte, the cobalt is present in a minor amount, in many typical cases from 1 to 3 gpl, in comparison with a nickel concentration of 75–100 gpl in an acid sulphate solution often having a pH of below pH 3. In the second category the nickel and cobalt are present in roughly similar amounts, typically about 1:1, the concentration of each of the two metals ranging up to for example, 30 gpl or higher or the cobalt is present in excess, even up to about 100 fold excess over the nickel. The solutions in this category are often obtained by the processing of tailings, e.g. from a copper extraction process or by reprocessing waste slags or calcines, and again are often in the form of acid sulphate solutions. Cobalt is currently removed from nickel/cobalt sulphate solutions in the first category by a multistep process which comprises taking a sidestream of nickel sulphate, neutralising it to about pH 11, with sodium hydroxide, oxidising the nickel to nickel (III) by anodic electrolysis, filtration of the resultant oxidised solution which is returned to the cobalt containing solution at pH 5.5. This process suffers from several practical disadvantages, including the fact that the oxidised nickel solution produced in the electrolysis is extremely difficult to filter, as is the cobalt precipitate obtained when the oxidised solution is used to oxidise the cobalt, with the result that filtration aids are necessary, which on separation from the cobalt leads to significant cobalt losses. Moreover, the cobalt precipitate produced contains a very high level of co-precipitated nickel and the process is relatively inflexible, in that it cannot cope easily with the trend towards extracting nickel from ores having an ever higher cobalt to nickel ratio. In view of the serious practical disadvantages of the aforementioned cobalt separation process, often referred to as the Outokumpu process, it is somewhat surprising that no alternative process has been adopted by the industry.

Various other methods for separating cobalt and nickel have been suggested, for example, the use of organic solvents to selectively extract the one metal or the other, but such solvents are generally very expensive. A further type of process involves the oxygen oxidation under pressure followed by reduction of nickel and cobalt with hydrogen but such a process requires the use of high pressures and expensive equipment. The use of a chlorine-based oxidising agent has also been proposed, such as sodium hypochlorite, but its use suffers from significant practical disadvantages, for example contamination of the solution with chloride ions rendering the by-product from the solution unsuitable for at least one of its major subsequent uses at present, i.e. for sale to fertiliser manufacturers, and secondly increased rates of corrosion arising from the chloride ions.

About 20 years ago, in U.S. Pat. No. 2,977,221 there was disclosed a process for separating nickel and cobalt in which a monoperoxo acid is introduced into an aqueous sulphate solution of the cobalt and nickel maintained at a pH of from 3 to 7, preferably 4.5 to 5.5. It employed in particular peroxomonosulphuric acid. The patent advocated the use of calcium hydroxide as the neutralising agent which it will be recognised is relatively impractical when applied to industrial solutions as opposed to dilute laboratory demonstrations in that addition of such a reagent would result in a considerable co-precipitation of calcium sulphate with precipitated cobalt hydroxides. Subsequent separation of the cobalt from the calcium sulphate would naturally entail considerably expenditure in view of the considerable volume of calcium sulphate co-precipitated. Clearly, therefore, a different neutralising agent is required. When we carried out experimentation, but using an alternative neutralising agent in conjunction with the Caro's Acid solution of the composition and by the method as described in the patent and particularly as apparently used in the Examples, the effect obtained was markedly inferior to that described by the patentee. It is reasonable to deduce, therefore, that there is non-equivalence of neutralising agents in such processes in at least some crucial respects and that in consequence the disclosure of the patentee in his Examples cannot be transferred as such without significant alteration to the use of other neutralising agents when employed under practical working conditions.

Continued investigation into a process using Caro's Acid revealed inter alia that the composition of the Caro's Acid solution was also of great importance when providing a viable process based upon its use, a matter upon which the patentee of U.S. Pat. No. 2,977,221 was wholly silent. In consequence, the U.S. patent does not present a practical method for the use of Caro's Acid.

According to the present invention, there is provided a process for the separation of cobalt and nickel from an aqueous acidic sulphate solution thereof, comprising the step of progressively introducing into said aqueous solution at least a stoichiometric amount of Caro's Acid based on the amount of peroxomonosulphuric acid required theoretically to oxidise all the cobalt in solution to cobalt (III), said Caro's Acid containing not more than 1 mole of hydrogen peroxide per 8 moles of peroxomonosulphuric acid, maintaining the aqueous solution of cobalt and nickel at a pH of not higher than pH 4.7 and not lower than a minimum ranging from pH 3.1 when the nickel to cobalt mole ratio in the solution before Caro's Acid introduction is 1:1 or lower up to pH 3.5 when said mole ratio is 40:1 or higher, by introduction thereinto of an alkali metal hydroxide, bicarbonate or carbonate, for a residence period of at least 2 hours after introduction of Caro's Acid Solution commences during which period cobalt hydroxide precipitates out of solution, and thereafter separating the precipitate from the aqueous phase.

Such a process enables the Caro's Acid effectively to oxidise the cobalt in solution and produces a precipitate that is more readily filtered than if it were permitted to remain in contact with the aqueous phase for only a short period of time, and if the Caro's Acid were added infrequently.

With respect to the amount of Caro's Acid to be employed, we have found that the minimum excess over the stoichiometric amount to achieve a predetermined cobalt removal tends to be dependent at least partly on the composition of the solution to be treated and the temperature of operation. We have found, that in batch processes, as the mole ratio of nickel to cobalt in the solution from which cobalt is to be removed selectively rises, a larger excess of over the stoichiometric amount of Caro's Acid is required. Thus, for example, in those circumstances in which nickel is present in a similar or low mole ratio to the cobalt in the region of e.g. 2:1 to 1:2 or 1:5 to 1:100, such as when the solution contains a high concentration of cobalt, for example of the order of 8 gpl or higher, often from 8 to 40 gpl, then only a relatively low amount of Caro's Acid need be employed, of the order of 1.4× and often from 1.4× to 1.8×, in a batch process. Herein, X represents the stoichiometric amount, based upon solely the peroxomonosulphuric acid content of the Caro's Acid, to oxidise the cobalt to Cobalt (III). Indeed, for the cobalt-rich solutions, very low additions of 1 to 1.4× prove to be very attractive also. Under such circumstances of up to 1.8× addition, provided the temperature of the solution is maintained at a temperature of below about 60° C., whilst the Caro's Acid is being brought into contact with it, extremely high removal of a cobalt from solution can be achieved. For example solutions having a residual content of less than 10 parts per million cobalt can be obtained from solutions having an initial concentration of 30 gpl, i.e. a removal of greater than 99.7%. Addition of Caro's Acid in a somewhat higher amount, such as 2× to 2.5× is preferable when such solutions are treated in a continuous process.

Where the solution contains initially a relative low concentration of cobalt, particularly in the range of from 1 to 4 gpl, though possibly somewhat higher, in the presence of a considerable excess of nickel, e.g. at least 10 fold the weight of cobalt and typically in the region of 70 to 100 g, we have found that in order to achieve residual cobalt levels of the order of 60 parts per million or lower, it is often necesssary to employ in batch processing in general, at least 2.3× Caro's Acid. In such circumstances the amount of Caro's Acid used will often be not more than 3.5×. When the process is carried out continuously, by which we mean that the nickel/cobalt sulphate solution and Caro's Acid are fed continuously into a body of mixture and neutralised and from which treated solution is withdrawn, then it is possible to achieve similar results using less Caro's Acid, for example in the range of 1.6× to 2.3×.

However, good results using such amounts of Caro's Acid are possible only when hydrogen peroxide content of that acid represents only a very small fraction thereof, and particularly good results occur when not more than 1 mole of hydrogen peroxide is present per 10 moles of peroxomonosulphuric acid. In the event that the Caro's Acid solution used has a hydrogen peroxide significantly higher, to an increasing extent it will become difficult to obtain cobalt precipitation. By way of example, Caro's Acid generated from 50% aqueous hydrogen peroxide and concentrated sulphuric acid as normally available in United States, at a mole ratio of sulphuric acid to hydrogen peroxide of 1.5:1, is substantially incapable of producing a solution having low residual cobalt level, even if a vast excess of Caro's Acid were employed, such as a total amount added of 5× or 10×, in that it is incapable in use of generating a sufficiently high electrochemical potential. This failure to act effectively, we now believe is attributable directly or indirectly to the presence of an excess amount of hydrogen peroxide. A further advantage of employing the specified Caro's Acid solution is the filterability of any cobalt precipitates obtained. As the mole ratio of $H_2SO_5$:$H_2O_2$ falls below 8:1 the cobalt particles become increasingly difficult and slow to filter, reaching a point at around 3:1 where the reaction medium becomes practically unfilterable.

In practice, we have found that there are considerable practical advantages obtained by introducing the Caro's Acid solution progressively into the solution from which cobalt is to be removed. By the term 'progressive' we mean either in small increments, preferably evenly timed over an extended period of time or in a continuous steam. In both cases at such a rate that the total period of introduction of the Caro's Acid is preferably at least 1 hour and particularly in the range of 1 to 6 often 1 to 4 hours in the case of a batch process. Naturally, the solution of cobalt and nickel is stirred or otherwise agitated throughout the period of introduction of the Caro's Acid so as to minimise, as far as possible, local variations of pH arising from the introduction of that Caro's Acid, since such variations tend to lead to an impaired performance, which manifests itself by way of increased Caro's Acid demand, or a higher residual level in solution. We have found that results continue to improve as the incremental method approximates more closely to continuous additions. Thus, although 20 increments can often be tolerated, the more frequent addition of increments of less than 1% of the total amount of Caro's Acid is preferred.

Where the removal of cobalt is carried out in a continuous process, progressive introduction of the Caro's Acid can be effected by introducing it throughout the period of in-feed of fresh nickel/cobalt solution, either continuously in a flow, at a rate adjusted as necessary, or by frequent small increments as from a metering pump, and either as a separate feed or by pre-introduction into the nickel/cobalt solution feed. In such circumstances, it is normal for rate of the feed of nickel/cobalt solution to remain substantially constant. The rate of feed of the Caro's Acid can conveniently be maintained at a preset ratio to the feed of nickel/cobalt sulphate giving for example an addition rate of 1.8× Caro's Acid. The cobalt level is preferably checked periodically and in accordance therewith the Caro's Acid feed can be adjusted. Frequently, the ratio of feed to volume of solution in the reaction tank is so arranged as to give a residence time of solution in the tank of at least 6 and preferably 8.25 to 12 hours. Such a long residence time has a similar effect to that obtained by introducing the Caro's Acid solution very slowly into a batch process for example over a total period of e.g. 4 to 6 hours, or introducing the Caro's Acid solution slightly faster, for example during a period of 1 to 2 hours and providing thereafter a further period during which consolidation of the cobalt precipitate can occur, such consolidation period often lasting from 1 to 3 hours, giving a total residence period, i.e. oxidant introduction and consolidation periods of from 3 to 6 hours, in many cases.

In general, the most practical convenient way of obtaining a Caro's Acid solution for use in the present process is by reaction between aqueous hydrogen peroxide and aqueous sulphuric acid. There are, however, two conflicting requirements in the generation of Caro's Acid having an appropriate composition. The first requirement is that the amount of sulphuric acid shall be as little as possible, for the simple economic reason that all the acid that is introduced into the nickel cobalt solution has to be neutralised, so that the more non-oxidising acid that is introduced, the more neutralising agent that also has to be introduced. The second requirement, though, is that the acid requirement shall be as high as possible in order to produce a Caro's Acid solution of acceptably low hydrogen peroxide content. Taking into account also the practicalities involved in generating a large volume of Caro's Acid, in that mixture of the aforementioned reactants leads inevitably to a high evolution of heat which could rapidly lead to a significant increase in the temperature of the solution and hence make it unstable we have found that a particularly convenient range of reagents comprises a mole ratio of from 2.7 to 3.5 moles of sulphuric acid per mole of hydrogen peroxide, employing a sulphuric acid solution having a content of from 93 to 99% by weight, the balance being water and optionally a small fraction of miscellaneous impurities as in, for example, so called smelter acid, and a hydrogen peroxide solution having a concentration of from 65 to 72% by weight hydrogen peroxide, the balance being water and a small amount, normally less than 0.5% by weight of stabilisers such as sodium pyrophosphate that are effective in acidic conditions. Conveniently, the Caro's Acid solution can be made by flowing the two reagent solutions simultaneously or sequentially in a predetermined weight ratio calculated to give the desired mole ratio into a body of equilibrium mixture of Caro's Acid, the body often being much greater than the total inflow per minute of reagents and maintaining the body at a temperature around or below ambient, for example 10° C. to 15° C. by cooling. Caro's Acid, when generated by the method described herein and employing the aforementioned mole ratio of sulphuric acid to hydrogen peroxide from the aforementioned starting reagents, in practice often has a concentration of peroxomonosulphuric acid of about 30% +/−2 or 3% by weight and a concentration of hydrogen peroxide of about 1% +/0.1% by weight giving an effective mole ratio of peroxomonosulphuric acid to hydrogen peroxide in solution centred about 10 to 1, usually 8:1 to 12:1, thereby enabling it to be used readily. Use of higher mole ratios of sulphuric acid to hydrogen peroxide with these strength reagents would lead not only to an increased neutralising agent demand proportionately as the mole ratio was increased, but would also tend to impair the precipitation process in that it would be more difficult to control load changes in pH where the acid is introduced. Lower mole ratios of these reagents would produce an increasingly impaired result arising from excessive amounts of hydrogen peroxide being present.

Although it is possible to use Caro's Acid undiluted, it is preferable to dilute it with water before use to a concentration of not more than 15% by weight peroxomonosulphuric acid. By so doing, improved Caro's Acid utilisation can be achieved. Dilution can be effected in a similar apparatus and using a similar method by which Caro's Acid was made from sulphuric acid and hydrogen peroxide, the reagents for dilution being water and concentrated Caro's Acid.

In many cases, a preferred pH range is from pH 3.9 to 4.5, within which the solution is maintained by introduction as needed of neutralising agent.

With respect to the addition of the neutralising agent, we have found that it is particularly convenient and advantageous to introduce it in the form of an aqueous solution, in many cases of greater than 1 M. By introducing the neutralising agent in such a manner, for example, in the range of from 1.5 M to 6 M, introduced into the stirred nickel/cobalt solution, the extent of local increases in pH can be minimised. Variations in the pH obtained at the point of precipitation and and the identity of the neutralising agent tend to influence the nature of the nickel species present in solution and in the precipitate and thus influence the extent of nickel contamination of the precipitate and the ease or difficulty of removing it. Such local increases, it will be recognized, can result in a precipitate having a reduced cobalt to nickel ratio. The neutralising agent can be added in response to decreases in pH occasioned by the introduction of the Caro's Acid, by linking the inflow control means to a pH detector. In practice, it is sometimes convenient to employ standard double metering pumps in which the two liquids are delivered in a predetermine volume ratio. Such equipment permits the relative volume ratio delivered to be adjusted within very wide ranges. By selecting the appropriate volume ratio on the basis of experience or a trial, a substantially constant predetermined pH can be maintained. Where desired, the primary or supplementary pH adjustment apparatus comprises a pH detector linked to an alkali supply, so as to demand it when the solution pH deviates beyond a predetermined limit, for example 0.05 or 0.1 pH units away from the preset pH of, for example 4.2 or 4.5.

Two particularly effective and convenient neutralising agents are sodium hydroxide and sodium carbonate. As between these neutralising agents, it is preferable to employ sodium carbonate when the initial nickel/cobalt ratio in the sulphate solution is similar, e.g. 2:1 to 1:2 or cobalt-rich such as 1:10 to 1:80 nickel:cobalt, and contains cobalt in a concentration of for example, from 0.5 to 30 gpl together with a correspondingly similar amount of nickel. By so doing, it has been found that the resultant precipitate tends to have a higher ratio of cobalt to nickel than when sodium hydroxide employed especially after washing the precipitate by the methods described later herein, but in both cases the precipitate can have a higher ratio of cobalt to nickel than would be obtained from an existing Outokumpu process. When the ratio of nickel to cobalt initially present in solution is high as in the first mentioned category of solutions, the differences between sodium hydroxide and sodium carbonate neutralising agents become less detectable, possibly on account of the comparatively small amount of oxidant added relative to the total metal content of the solution.

Solutions containing a high concentration of nickel, e.g. 60 gpl or higher and only a low concentration of cobalt e.g. 1 to 4 gpl, can conveniently be treated at any temperature from 10° to 80° C., but solutions containing substantially equal, in the 2:1 to 1:2 mole ratio of nickel to cobalt are preferably treated at a temperature from 10° to 60° C., and especially from 15° to 50° C., particularly when the cobalt concentration is at least 8 gpl.

In a modification of the above-mentioned process, there is employed as the neutralising agent ammonium hydroxide, bicarbonate or carbonate and the nickel and cobalt solution is treated at a pH maintained in the range of from pH 4.3 to 4.7. Surprisingly, it has been found that when ammonium hydroxide is employed as the neutralising agent, not only does the efficiency of cobalt removal from solution diminish rapidly as the pH at which the solution is maintained is increasingly lower than 4.3, the rate of fall off being markedly greater than for the alkali metal neutralising agents such as sodium hydroxide or sodium carbonate, but in addition it has been found that the rate of cobalt removal diminishes also as the pH at which the solution is maintained is increased above pH 4.7. The latter phenomenon, we believe, arises from the formation in solution of a pentammino aqua cobalt (III) sulphate complex which is water-soluble. To minimise the rate of formation, of the complex, the concentration of ammonium ion in solution, calculated as ammonium sulphate, is preferably not above 20 gpl per liter when the cobalt concentration in solution is at a relatively high level in batch processes or at a steady state level in continuous processes. Therefore, in circumstances relating to the overall nickel extraction process which make it desirable to employ e.g. ammonium hydroxide and in which the solution before cobalt removal contains ammonium sulphate, it is prudent to effect the process batch-wise, to maximise the proportion of the precipitation the cobalt that takes place at the preferred lower concentration of ammonium ions in solution. Of course, by using a plurality of tanks, to separate the tank filling, treating and filtrate ion stages, a continuous feed of nickel/cobalt solution can be treated. A process using an ammonium neutralising agent is preferably carried out at 75° C. or higher.

Further improvement in the cobalt to nickel ratio in the precipitate can be achieved after its separation from the aqueous phase by subsequent washing steps. These washing steps can include one or more water and/or acid washing steps under the known conditions of pH and temperature to effect preferential solubilisation of nickel oxide/hydroxide. By water washing, the cobalt-/nickel ratio can be increased by a factor often in the range of 1.5:1 to 2:1 and by hot acid washing (often at pH 3) and water washing by a factor of often in the range of 6:1 to 20:1. The washing stages can either be effected by reslurrying the precipitate at a pulp density of from 10 to 50% or by passing the washing liquid through the solid precipitate cake. In practice, the combination of the precipitation stage and the subsequent washing stages means that extremely efficient separation of cobalt and nickel can occur. Thus, for example, by using techniques as described herein and sodium carbonate neutralising agent it is possible to obtain from a solution containing initially cobalt and nickel in substantially equal amounts such as 10 to 30 gpl a nickel solution containing only a few parts per million cobalt, i.e. a premium nickel sulphate solution, and a cobalt precipitate in which the cobalt/nickel ratio is greater than 50:1 i.e. again a premium product. Furthermore, it will be recognised that by effecting such efficient separation, the effective losses of both cobalt and nickel can be minimised.

Having described the invention in general terms, specific examples thereof will now be described more fully by way of example only. It will be understood that the skilled hydrometallurgist can depart from the particular embodiments described hereinafter whilst still remaining in general limits of the invention, always provided that his departures are in accordance with the aforementioned generalised passages.

EXAMPLES

In the examples and comparisons, the concentrations of cobalt and nickel in solution and the ratio of cobalt and nickel in the precipitate were measured using conventional atomic absorption spectrophotometric techniques, using matrix matching to make allowance for any other impurities that are present. Such techniques are described by W T Elwell and J A F Gridley in "Atomic Absorption Spectrophotometry" Second Edition, published by the Pergammon Press.

Where the expression ppm is used, it indicates parts per million by weight unless otherwise specified.

EXAMPLES 1–4

In Examples 1 to 4, the nickel/cobalt solution to be treated had been obtained by dissolution of a nickel matte in sulphuric acid and contained 80 gpl nickel and 2 gpl cobalt, as the metal and 120 gpl sodium sulphate. In each of the Examples, a 250 ml sample of the solution was adjusted to the desired pH using the specified concentration of aqueous sodium hydroxide solution, given in Table 1 hereinafter. A Caro's Acid solution was then introduced continuously and evenly over a period of 2 hours, to a total amount of 3× i.e. 300% of the stoichiometric amount of peroxomonosulphuric acid content required for oxidising the cobalt. The Caro's Acid solution was prepared by reaction between approximately 70% aqueous hydrogen peroxide and 98% sulphuric acid in a mole ratio of sulphuric acid to hydrogen peroxide of 3 to 1, and thereafter diluted with demineralised water to give a concentration of 10% peroxomonosulphuric acid and approximately 0.3% hydrogen peroxide. Throughout the period of introduction of the Caro's Acid, and thereafter, of the nickel/cobalt solution was maintained at ambient temperature (about 22° C.) and its pH was monitored by a pH stat which governed the introduction of further amounts, as necessary, of the specified neutralising agent to maintain the desired pH. The nickel solution was stirred for a further 2 hours to give a total residence time in the reaction vessel of 4 hours. At the end of the contact period, the precipitate was filtered off from the nickel sulphate solution, and the residual cobalt content of the solution was then measured. The filter cake was then washed with a small volume of hot (70° C.) sulphuric acid at pH 3 followed by a small volume of water at ambient temperature and the nickel and cobalt content of the cake were then measured again, except in Example 1 in which only the water washing step was carried out.

The results are summarised in Table 1 below.

TABLE 1

| Ex No | pH | Neutralisation Agent and concentration | Cobalt in filtrate ppm | Co:Ni Mole Ratio in Filter Cake |
|---|---|---|---|---|
| 1 | 4.2 | NaOH-5N | 7 | 0.67:1 |
| 2 | 4.2 | NaOH-2N | 5 | 4.7:1 |
| 3 | 4.2 | NaOH-5N | 5 | 21.8:1 |
| 4 | 3.8 | NaOH-5N | 6 | 22.5:1 |

From Table 1 it can be seen that an extremely effective removal of cobalt from the solution can be achieved and secondly that even though the initial ratio of nickel to cobalt in solution was 40 to 1, it was possible to obtain a filter cake using this process which had a ratio of cobalt to nickel of over 20 to 1, representing a selectivity of about 800.

EXAMPLES 5–10

Examples 5 to 10 were carried out using the same general method, nickel/cobalt solution, Caro's Acid at the same composition and the same method of its making as in Examples 1 to 4. The neutralising agent employed was sodium hydroxide at the concentration of 2 N. The Caro's Acid was introduced in two different modes. In Examples 5, 7 and 9 it was added in about 20 equal increments, spaced evenly throughout the addition period of 2 hours, as indicated by I in the Table 2.

In Examples 6, 8 and 10 the Caro's Acid solution was added evenly and continuously throughout a 2 hour introduction period. In all Examples the solution was stirred for 2 hours more and then filtered. The reaction conditions and final cobalt level in the solution after 4 hours residence time are summarised in Table 2 below.

TABLE 2

| Ex No | pH | Temperature °C. | Addition Mode | Cobalt in Solution ppm |
|---|---|---|---|---|
| 5 | 4.5 | 25 | I | 89 |
| 6 | 4.5 | 25 | C | 2 |
| 7 | 4.5 | 70 | I | 54 |
| 8 | 4.5 | 70 | C | 2 |
| 9 | 3.7 | 25 | I | 1013 |
| 10 | 3.7 | 25 | C | 6 |

From Table 2 it can be seen that a considerable improvement in the efficiency of removal of cobalt from solution if Caro's Acid addition was effected continuously instead of in equal increments, when each increment represented about 5% of the total amount of Caro's Acid introduced, or otherwise 15% of the stoichiometric amount to oxidise all the cobalt. At pH 4.5, the amount of cobalt remaining in solution was approximately 4.5 and 2.7% respectively of the starting concentration so that the separation was bordering on commercially acceptable levels. When the number of increments was increased to approximately 100 or higher, the residual cobalt level approached much more closely that obtained in the continuous introduction system. In addition, the method of introduction of the Caro's Acid can be seen to be more critical at lower pH's.

EXAMPLE 11 AND COMPARISONS 12–14

Example 11 and Comparisons 12 to 14 demonstrate the effect of increasing the hydrogen peroxide to peroxomonosulphuric acid ratio in the Caro's Acid used. Each of the Examples and comparisons was carried out by introducing continuously over a period of 2 hours a Caro's Acid solution of the specified composition. The nickel/cobalt solution had a concentration of 95 gpl nickel, 2 gpl cobalt and 20 gpl ammonium sulphate sulphate. The pH of the solution was adjusted to pH 4.5 and maintained at that pH by addition as necessary of ammonium hydroxide. The reaction temperature was 80° C. The total residence time for the system was 4 hours, after which the cobalt content of the solution was measured. The results are summarised in Table 3 below.

TABLE 3

| Ex/comparison No | Caro's Acid composition $H_2SO_5$ wt % | Caro's Acid composition $H_2O_2$ wt % | Cobalt in solution ppm |
|---|---|---|---|
| 11 | 10 | 0.35 | 48 |
| C12 | 9.3 | 0.70 | 380 |
| C13 | 8.8 | 1.10 | 640 |
| C14 | 9.7 | 2.01 | 2000 |

From Table 3 it can be seen that a very marked improvement was obtained by reducing the hydrogen peroxide content of the solution from 0.7 to 0.35% in that the cobalt removal was increased from approximately 80% to in excess of 97%. It will be recognised that the Caro's Acid composition of Example 11 is in essence the same as that employed in the preceding Examples. Further investigations revealed that the residual cobalt in Example 11 was present mainly in the cobalt (III) oxidation state, and we believe in an amine complex of approximate formula $(Co(NH_3)_5.H_2O)_2.(SO_4)_3$. When the level of ammonia in the solution was increased by maintaining a free reaction pH of pH 5 but under otherwise the same conditions, a much higher cobalt residual level in solution was obtained, it again being present in the cobalt (III) oxidation state.

EXAMPLES 15 TO 18, AND 20 AND COMPARISON 19

In Examples 15 to 18, comparison 19 and Example 20, the cobalt/nickel solution to be treated contained cobalt and nickel each in a concentration of 10 gpl, calculated as the metal, at present in a sulphuric acid solution, with the exception of Example 20 in which the cobalt and nickel concentrations were each initially at 30 gpl. In each of the Examples and comparisons, the experimental procedure comprised introducing Caro's Acid solution produced from 98% sulphuric acid and 70% hydrogen peroxide in a 3:1 mole ratio as produced by the method described for Examples 1 to 4 and diluted with demineralised water to give a product having a final analysis of 10.32% by wt. peroxomonosulphuric acid and 0.16% by wt. hydrogen peroxide. The period of introduction of the Caro's Acid lasted 4 hours in each case, and the total amount introduced was 1.5×. The solution was maintained throughout at the reaction temperature specified in Table 4, and the neutralising agent, again as specified, was introduced under control of a pH stat to maintain the predetermined pH. At the end of the period of introduction, the solution was filtered under gravity, and the cobalt content of the filtrate determined.

The precipitate was slurried with hot sulphuric acid for a period of 2 hours, refiltered and the cobalt and nickel content determined. The results are summarised in Table 4 below.

TABLE 4

| Ex/Comparison No | pH | Temp °C. | Neutralising Agent | Co content in filtrate ppm | Co:Ni mole ratio in filter cake |
|---|---|---|---|---|---|
| 15 | 3.5 | 25 | NaOH | 10 | 16:1 |
| 16 | 4.0 | 25 | $Na_2CO_3$ | 3 | 63:1 |
| 17 | 3.2 | 25 | $Na_2CO_3$ | 45 | 72:1 |
| 18 | 4.5 | 40 | $Na_2CO_3$ | 2 | 19:1 |
| C19 | 5.2 | 40 | $Na_2CO_3$ | 2 | 3:1 |
| 20 | 4.5 | 40 | NaOH | 3 | 11:1 |

From Table 4 it can be seen that the process of the present invention can reduce the cobalt content of solutions containing initially even as high as 30 gpl cobalt to a final concentration of below 10 parts per million. Moreover, the filter cake obtained, after acid washing can have an extremely low nickel content, present in a mole ratio to cobalt of less than 1:50, for the system particularly suitable results being obtained at a pH in the region of pH 4.

When a similar process to that in Examples 15 to 18 was carried out but introducing the Caro's Acid in large increments, each representing roughly 5% of the total amount introduced, at a pH maintainfed in the region of 3.5 to 4.5, markedly inferior results were obtained, the residual cobalt contents in solution being in the range of from 240 to 640 ppm. When such results are compared with the results obtained using similar incremental amounts but for only 2 gpl cobalt solutions, it can be seen that it becomes more critical to approach closely continuous addition mode as the concentration of the cobalt increases.

EXAMPLES 21 AND 22

In Examples 21 and 22, Caro's Acid solution prepared by the general method and using the reagents and mole ratio of about 3:1 described for Examples 1 to 8. It was used without any dilution i.e. 33% peroxomonosulphuric acid in Example 21 and after dilution to 10% in Example 22. In each Example, the Caro's Acid was introduced dropwise over a period of 2 hours into a solution obtained as in Examples 1 and 4 and containing 80 gpl nickel, 2 gpl cobalt and 120 gpl sodium sulphate in a total amount of 2.5×. The solution was maintained at ambient temperature throughout, and at a pH of 4.2 by introduction of sodium hydroxide solution, governed by a pH stat. The aqueous phase and precipitate were kept in contact for a further period of 2 hours, at the end of which were separated, and the residual cobalt level in solution measured. In Example 21 the residual level was 105 ppm and in Example 22 was 11.5 ppm.

From a comparison of Examples 21 and 22, it will be observed that a substantial improvement in the residual level of cobalt in solution was obtained by diluting the Caro's Acid before use. By comparison between Example 21 and earlier Examples 1–4, it will be observed that residual cobalt level of Example 21 could also have been reduced by increasing the amount of Caro's Acid added to 3×.

EXAMPLES 23 TO 25

In these Examples, precipitation of cobalt from an aqueous solution was carried out continuously at a constant rate specified in Table 5 by introducing a feed of nickel/cobalt solution near the bottom of a large vessel containing sufficient solution to give a residence time as specified in Table 5, and withdrawing solution from near the top of the vessel at the appropriate rate to keep the volume constant for filtration. At the end of continuous running in Example 23 (13 hours), the flow rate of in-feed was increased so that the residence time was correspondingly reduced. Similarly, at the end of 10 hours running in Example 24, the rate of in-feed was decreased slightly, thereby correspondingly increasing the residence time.

The nickel/cobalt solution used was the same as that in Examples 1 to 4. The Caro's Acid solution used had also been prepared from the reagents and mole ratios specified in Examples 1 to 4 diluted to the figure in the Table with DMW and was metered in continuously at a preset rate relative to the feed rate of nickel/cobalt solution in an amount of 1.8×, at a feed point adjacent to that of the nickel/cobalt feed point. The pH of the solution was constantly monitored and aqueous sodium hydroxide solutions (SN) automatically introduced, as necessary, under the control of a pH stat to maintain the pH at pH 4.2. The solution was stirred, and its temperature 25° C., throughout. In order to check that oxidising conditions were maintained, the Emf of the solution was monitored using a platinum/calomel electrode system. The unadjusted value of the Emf, i.e. as measured, is given herein. The residual cobalt levels were measured periodically at the time specified after start-up of continuous running in that Example (Sample Time). The results and conditions are summarised in Table 5.

TABLE 5

| Ex No. | Ni/Co feed ml/min | Oxidant $H_2SO_5$ wt. % | Emf mV | Residence Time hours | Residual Co ppm | Sample Time (hours) |
|---|---|---|---|---|---|---|
| 23a | 2 | 7.75 | 960 | 10 | 3.4 | 4.5 |
| 23b | 2 | 7.75 | 1020 | 10 | 1.2 | 8.5 |
| 23c | 2 | 7.75 | 1040 | 10 | 4.2 | 12 |
| 24a | 2.5 | 10.1 | 1020 | 8 | 7.0 | 4 |
| 24b | 2.5 | 10.1 | 1090 | 8 | 12.8 | 8 |
| 24c | 2.5 | 10.1 | 1060 | 8 | 28.5 | 10 |
| 25a | 2.33 | 10.1 | 1050 | 8.5 | 13.3 | 5.7 |
| 25b | 2.33 | 10.1 | 1100 | 8.5 | 7.8 | 8.5 |
| 25c | 2.33 | 10.1 | 1040 | 8.5 | 4.8 | 12.5 |
| 25d | 2.33 | 10.1 | 960 | 8.5 | 2.7 | 21 |

From Table 5, it can be seen that extremely good results were obtained in Example 23 which had a residence time of 10 hours. When the rate of feed of Ni/Co solution in the vessel was increased to give a residence time of 8 hours, then, after a period of continuous running, a higher equilibrium level of cobalt was being approached. When the rate of in-feed was reduced slightly to increase the residence time to 8.5 hours, the residual cobalt level gradually fell back to approximately its original level.

EXAMPLE 26

In this Example, the general procedure was the same as that employed in Examples 15 to 20, but employing a feed solution of cobalt/nickel sulphates in a total metal concentration of 10 g/l and cobalt:nickel weight ratio of 10:1. The reaction pH was maintained at 3.5 using sodium carbonate, and a total of 3× Caro's Acid was added. The resultant solution contained 253 ppm cobalt, and the precipitate 99.2% of the initial amount. The precipitate after simple water washing contained only a small amount of nickel, 1 part by weight to 184 parts cobalt and after washing with dilute sulphuric acid maintained at pH 3 at 75° C. the purity had been increased to 1 part in 394 parts.

When the Example was repeated at pH 4.5 using either sodium carbonate or sodium hydroxide, the residual level of cobalt in the solution fell to below 10 ppm, even when 1.1× or 1.5× Caro's Acid was used, but the final washed precipitates tended to have higher nickel contents at the higher pH and as the X factor was reduced and when using the hydroxide.

EXAMPLE 27

In this Example, the procedure of Example 26 was followed employing a feed solution of cobalt/nickel sulphates at an 80:1 cobalt/nickel weight ratio and a total metals concentration of 10 g/l. At a reaction pH of 3.5 with sodium carbonate, temperature of 50° C., and 1.5× Caro's Acid addition, 99.3% by weight of the cobalt was precipitated and the nickel level in the precipitate was 1 part to 540 parts cobalt after simple water washing and 1 part to 1080 parts after acid washing as in Example 26.

We claim:

1. In a process for the separation of cobalt and nickel from an aqueous acidic sulphate solution thereof in which Caro's Acid is introduced into said aqueous solution, and is at least partially neutralised by introduction of a neutralising agent, resulting in a cobalt-containing precipitate, and the resultant precipitate is separated from the residual aqueous phase, the improvement which comprises employing at least a stoichiometric amount of Caro's Acid based on the amount of peroxomonosulphuric acid required theoretically to oxidise all the cobalt in solution to cobalt (III), said Caro's Acid containing not more than 1 mole of hydrogen peroxide per 8 moles of peroxomonosulphuric acid, maintaining the aqueous solution of cobalt and nickel at a pH of not more than pH 4.7 and at a minimum pH ranging from pH 3.1 when the nickel to cobalt mole ratio in the solution before Caro's Acid introduction is 1:1 or lower up to pH 3.5 when said mole ratio is 40:1 or higher, by introduction thereinto of an alkali metal hydroxide or carbonate, for a period of at least 2 hours after introduction of Caro's Acid solution commences, during which period cobalt hydroxide precipitates out of solution.

2. A process according to claim 1 wherein the Caro's Acid is introduced continuously or in increments each of less than 1% of the total amount added.

3. A process according to claim 1 or 2 wherein the Caro's Acid used is produced by reaction between 93 to 98% by weight sulphuric acid and 65 to 72% by weight aqueous hydrogen peroxide solution in a mole ratio of $H_2SO_4$:$H_2O_2$ of from 2.7:1 to 3.5:1.

4. A process according to claim 3 wherein the Caro's Acid is diluted to below 15% by weight concentration of peroxomonosulphuric acid before introduction into the cobalt solution.

5. A process according to claim 1 wherein the nickel/cobalt solution has a high nickel and low cobalt concentration and is treated with 2.3 to 3.5 times the stoichiometric amount of Caro's Acid based on the cobalt in a batch process.

6. A process according to claim 1 wherein the nickel/cobalt solution has a similar nickel and cobalt concentrations or is cobalt-rich and is treated with up to 1.8 times the stoichiometric amount of Caro's Acid based on the cobalt in a batch process.

7. A process according to claim 6 wherein the neutralisation agent used is sodium carbonate.

8. A process according to claim 5 or 6 wherein the Caro's Acid is introduced progressively during a period of at least 1 hour in a batch process.

9. A process according to claim 8 wherein the residence time is from 3 to 6 hours.

10. A process according to claim 1 wherein the nickel/cobalt solution has a high nickel and low cobalt concentration and is treated with 1.6 to 2.3 times a stoichiometric amount of Caro's Acid in a continuous process.

11. A process according to claim 5 or 10 wherein the nickel cobalt solution is maintained at a pH from 3.9 to 4.5.

12. A process according to claim 1 wherein nickel/cobalt solution has a similar nickel and cobalt concentrations and is treated with 2 to 2.5 times a stoichiometric amount of Caro's Acid in a continuous process.

13. A process according to claim 10 or 12 wherein the residence time is from 8.25 to 12 hours.

14. A modification of the process according to claim 1, 4 or 7 wherein the pH of the solution is maintained at from pH 4.3 to 4.7 and the neutralising agent is ammonium hydroxide, bicarbonate or carbonate.

15. A process according to claim 14 wherein the nickel/cobalt solution has a high nickel and low cobalt concentration and is treated with 2.3 to 3.5 times the stoichiometric amount of Caro's Acid based on the cobalt in a batch process.

16. A process according to claim 15 wherein the greater part of the cobalt is precipitated from a solution containing less than 20 gpl ammonium sulphate.

17. A process according to claim 5, 7, 10, or 12 wherein the Caro's Acid used is produced by reaction between 93 to 98% by weight sulphuric acid and 65 to 72% by weight aqueous hydrogen peroxide solution in a mole ratio of $H_2SO_4$:$H_2O_2$ of from 2.7:1 to 3.5:1 then is introduced continuously or in increments each of less than 1% of the total amount added and is diluted to below 15% by weight.

18. A process according to claim 17 wherein the precipitate is acid washed.

19. A process according to claim 14 wherein the Caro's Acid used is produced by reaction between 93 to 98% by weight sulphuric acid and 65 to 72% by weight aqueous hydrogen peroxide solution in a mole ratio of $H_2SO_4$: $H_2O_2$ of from 2.7:1 to 3.5:1 then is introduced continuously or in increments each of less than 1% of the total amount added and is diluted to below 15% by weight.

* * * * *